US005875626A

United States Patent [19]

Cromartie

[11] Patent Number: 5,875,626

[45] Date of Patent: Mar. 2, 1999

[54] ADAPTER FOR ROTATABLY SUPPORTING A YARN CARRIER IN A WINDING ASSEMBLY OF A YARN PROCESSING MACHINE

[75] Inventor: Fred Cromartie, Hartsville, S.C.

[73] Assignee: Sonoco Products Company, Hartsville, S.C.

[21] Appl. No.: 949,363

[22] Filed: Oct. 14, 1997

Related U.S. Application Data

[63] Continuation-in-part of Ser. No. 721,476, Sep. 27, 1996, Pat. No. 5,711,142.

[51] Int. Cl.[6] ..... D01H 9/00

[52] U.S. Cl. ..... 57/1 R; 242/129.51; 242/596.7; 242/476.2; 242/476.5; 242/476.6

[58] Field of Search ..... 57/1 R; 242/129.51, 242/596.7, 364.4, 476.1, 476.2, 476.5, 476.6

[56] References Cited

U.S. PATENT DOCUMENTS

| | | | |
|---|---|---|---|
| 1,693,876 | 12/1928 | Unruh | 242/599.2 |
| 1,975,743 | 10/1934 | Gollong | 242/46.5 |
| 2,898,054 | 8/1959 | Rea | 242/18 |
| 3,801,038 | 4/1974 | Wust | 242/18 PW |
| 3,809,326 | 5/1974 | Wust | 242/18 WP |
| 3,831,869 | 8/1974 | Sartori | 242/18 R |
| 4,125,229 | 11/1978 | Dillon | 242/18 R |
| 4,299,357 | 11/1981 | Munker | 242/18 DD |
| 4,328,928 | 5/1982 | Zang | 242/18 DD |
| 4,477,034 | 10/1984 | Oswald | 242/18 PW |
| 4,700,834 | 10/1987 | Martinez | 242/388 |
| 4,700,904 | 10/1987 | Martinez | 242/18 R |
| 4,819,892 | 4/1989 | Schurmann et al. | 242/18 PW |
| 4,832,281 | 5/1989 | Payne et al. | 242/18 PW |
| 5,014,928 | 5/1991 | Gandy et al. | 242/118.32 |
| 5,169,080 | 12/1992 | Bartkowiak | 242/18 PW |
| 5,170,961 | 12/1992 | Bolz et al. | 242/18 DD |

FOREIGN PATENT DOCUMENTS

| | | | |
|---|---|---|---|
| 2536477 | 7/1976 | Germany | 242/18 PW |
| 2747771 | 7/1978 | Germany | 242/18 PW |
| 2936392 | 10/1980 | Germany | 242/18 PW |
| 53-755 | 4/1979 | Japan | 242/18 PW |
| 40-4182274 | 6/1992 | Japan | 242/18 PW |
| 231011 | 6/1986 | U.S.S.R. . | |

*Primary Examiner*—William Stryjewski
*Attorney, Agent, or Firm*—Bell Seltzer Intellectual Property Law Group of Alston & Bird LLP

[57] ABSTRACT

An adapter for rotatably supporting a tubular end of a yarn carrier in a take-up winding assembly of a yarn processing machine which accommodates the placement of a yarn transfer tail across an end surface of the yarn carrier between the yarn carrier and the adapter without breaking or cutting of the yarn transfer tail during winding of the yarn. The adapter includes a hub portion for extending axially into the tubular end of the yarn carrier to center the yarn carrier on the adapter and which has an outside surface with a cross-sectional diameter less than the diameter of an adjacent inside surface of the yarn carrier for defining a space therebetween to accommodate the placement of the yarn tail. An annular flange portion extends radially outwardly from the rear of the hub portion and has an inside surface for being positioned adjacent the end surface of the yarn carrier. Members, preferably in the form of equally spaced ribs or spherical members, are formed on the annular flange portion (1) for abutting the end surface of the yarn carrier to define a space between the end surface of the yarn carrier and the inside surface of the annular flange to accommodate the placement of the yarn tail and (2) for engaging and, preferably slightly penetrating, the end surface of the yarn carrier to retard relative rotation between the yarn carrier and the adapter.

3 Claims, 3 Drawing Sheets

ADAPTER FOR ROTATABLY SUPPORTING A YARN CARRIER IN A WINDING ASSEMBLY OF A YARN PROCESSING MACHINE

RELATED APPLICATIONS

This application is a continuation-in-part of U.S. patent application Ser. No. 08/721,476, filed on Sep. 27, 1996, now U.S. Pat. No. 5,711,142, which is hereby incorporated herein in its entirety by reference.

FIELD OF THE INVENTION

This invention relates to an adapter for rotatably supporting a tubular end of a yarn carrier in a take-up winding assembly of a yarn processing machine and which is characterized by a construction which accommodates the placement of a yarn transfer tail across an end surface of the yarn carrier and between the yarn carrier and the adapter without breaking or cutting of the yarn transfer tail during winding of the yarn.

BACKGROUND OF THE INVENTION

In the winding of textile yarn on a cone or tube carrier in a take-up winding assembly of a yarn processing machine, such as an open-end spinning, ring spinning, two-for-one twisting machine, etc., a yarn transfer tail is wrapped around the bottom of the carrier and is positioned between the carrier and an adapter in the winding assembly, which is constructed for rotatably supporting a tubular end of the yarn carrier in the winding assembly. The resulting pinching action on the yarn transfer tail between the end of the yarn carrier and the face of the adapter and friction between the yarn carrier and the adapter, created by relative rotation between the adapter and carrier during the winding operation, often causes breakage or cutting of the yarn transfer tail which is undesirable.

Various attempts have been made to modify the end of the yarn carrier to provide a groove, soft surface or some other construction to receive the yarn transfer tail and to prevent this undesirable breakage or cutting of the yarn transfer tail. In this regard, attention is directed to U.S. Pat. Nos. 4,700,834; 4,700,904, 5,014,928 and 5,170,961 which relate to attempts to modify the end of the yarn carrier to prevent this undesirable breakage or cutting of the yarn transfer tail during a winding operation. Although some of these modified yarn carrier end constructions reduced some of the yarn tail breakage or cutting, this approach did not satisfactorily overcome this problem.

OBJECT AND SUMMARY OF THE INVENTION

Accordingly, it is an object of this invention to overcome the above problem of yarn transfer tail breakage or cutting during a winding operation of yarn on a cone or tube carrier in a yarn processing machine.

It has been found by this invention that this object may be accomplished by providing an improved adapter for rotatably supporting a tubular end of a yarn carrier in a take-up winding assembly of a yarn processing machine and which is specifically characterized by a construction which accommodates the placement of a yarn transfer tail across an end surface of the yarn carrier and between the yarn carrier and the adapter without breaking or cutting of the yarn transfer tail. This improved adapter includes the following construction.

A hub portion is provided for extending axially into the tubular end of the yarn carrier to center the yarn carrier on the adapter and which has an outside surface with a cross-sectional diameter less than the diameter of an adjacent inside surface of the yarn carrier for defining a space therebetween to accommodate the placement of the yarn tail. An annular flange portion extends radially outwardly from the rear of the hub portion and has an inside surface for being positioned adjacent the end surface of the yarn carrier.

Means are formed on the annular flange portion (1) for abutting the end surface of the yarn carrier to define a space between the end surface of the yarn carrier and the inside surface of the annular flange to accommodate the placement of the yarn tail and (2) for engaging the end surface of the yarn carrier to retard relative rotation between the yarn carrier and the adapter. Preferably, this means formed on the annular flange portion comprises spaced ribs extending axially from the inside surface of the annular flange portion and extending radially along the entire radial length of the annular flange portion. These spaced ribs and the annular flange preferably have a radial length substantially equal to at least the radial length of the end surface of the yarn carrier so that the ribs abut the end surface of the yarn carrier along substantially the entire radial length thereof to define the yarn tail receiving space between the end surface of the yarn carrier and the annular flange of the adapter.

With this construction of an adapter for rotatably supporting a tubular end of a yarn carrier in a take-up winding assembly of a yarn processing machine, a construction is provided which defines a space between the adapter and yarn carrier to accommodate placement of the yarn tail therein without pinching the yarn transfer tail between the yarn carrier and the adapter and which eliminates friction on the yarn transfer tail between the yarn carrier and the adapter which is caused by relative rotation between these two members, both of which cause breakage or cutting of the yarn transfer tail during the yarn winding operation in the yarn processing machine.

BRIEF DESCRIPTION OF THE DRAWINGS

Some of the objects and advantages of this invention having been stated, other objects and advantages will be apparent in the detailed description of the preferred embodiment of the invention, when taken in conjunction with the accompanying drawings, in which.

DETAILED DESCRIPTION OF PREFERRED EMBODIMENTS OF THE INVENTION

Referring now to FIGS. 1–7 of the drawings, a preferred first embodiment of an adapter, generally indicated at 10, is shown therein for rotatably supporting a tubular end of a yarn carrier 20 in a take-up winding assembly W of a yarn processing machine P. Yarn Y after being processed in the yarn processing machine P is wound in the take-up winding assembly W onto the yarn carrier 20 rotatably supported on the adapter 10, constructed in accordance with this invention, and carried in the take-up winding assembly W.

Figure 1:
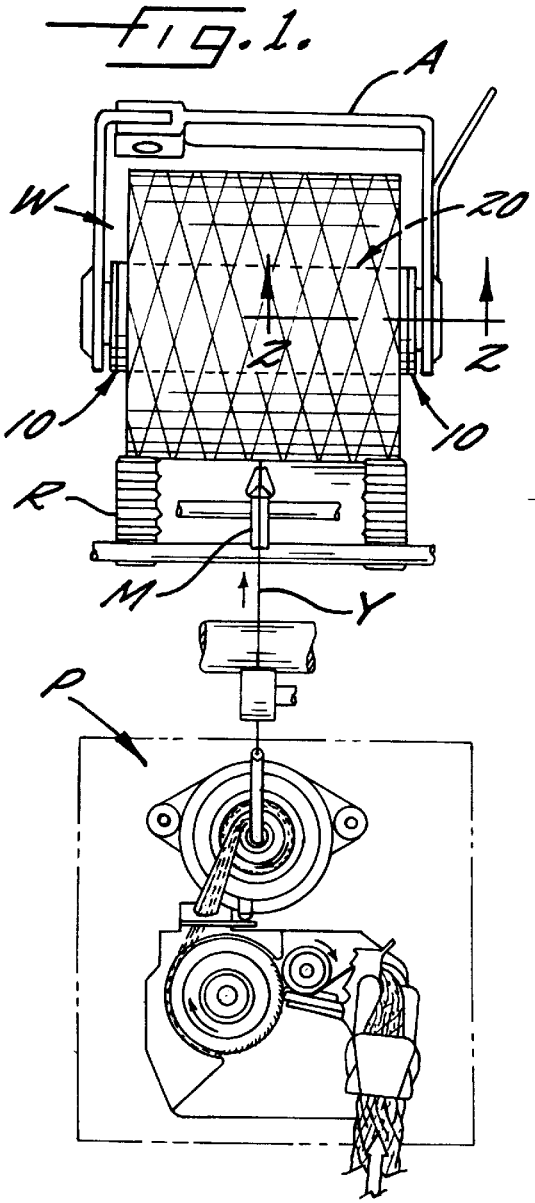
FIG. 1 is a schematic elevational view of a yarn processing machine having a take-up winding assembly utilizing the improved adapter construction of this invention for supporting a yarn carrier.

The yarn processing machine P in which the improved adapter 10 of this invention is utilized, may be any type of spinning, twisting or other type of yarn processing machine. As schematically illustrated in FIG. 1, the yarn processing machine P is an open end spinning machine of a type well known to those with skill in the art and the construction and detail thereof is not necessary for an understanding of the present invention.

After processing of the yarn Y in the yarn processing machine P, the yarn Y is fed to a take-up winding assembly W which may be any suitable type of take-up winding assembly. As illustrated in FIG. 1, this winding assembly W includes a traversing mechanism M which traverses the yarn Y back and forth along the yarn carrier 20 to form a package of wound yarn Y thereon. The carrier 20 is rotated by a driven friction drive roll R which engages the outside surface of the package of wound yarn Y on the carrier 20 and rotates such package. The adapter 10 is carried by yolk arm assembly A, which in this type of take-up winding assembly W includes an adapter 10 on each side of the yarn carrier 20. Each of the adapters 10 are rotatably mounted in the yolk arm assembly A by a bearing mechanism B. The yolk arm assembly A may be opened up for removing of the yarn core 20 and wound package of yarn Y thereon by pivoting one end of the yolk arm assembly A to spread the yolk arms apart, in a manner well understood by those with ordinary skill in the art.

The yarn carrier 20 utilized in this type of take-up winding assembly W of a open end spinning yarn processing machine P is a cylindrical tube type carrier. However, other types of yarn carriers, such as cones or the like, may also be utilized in other types of take-up winding mechanisms and the improved adapter 10 of this invention may be used for the purposes discussed broadly above and more specifically below. The carrier 20 may also be constructed of paper, plastic or any conventional material utilized for construction of such yarn carriers. However, it is preferred to utilize a paper yarn carrier 20 for the reasons discussed below.

Figure 3:
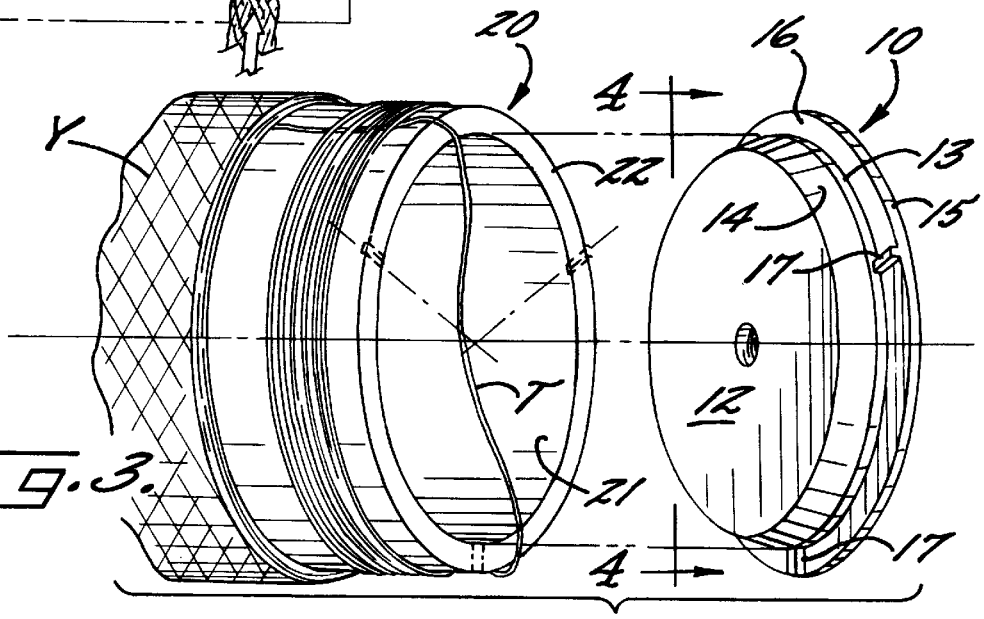
FIG. 3 is an exploded perspective view of the end of the yarn carrier and the adapter of this invention taken from FIG. 2.
Figure 4:
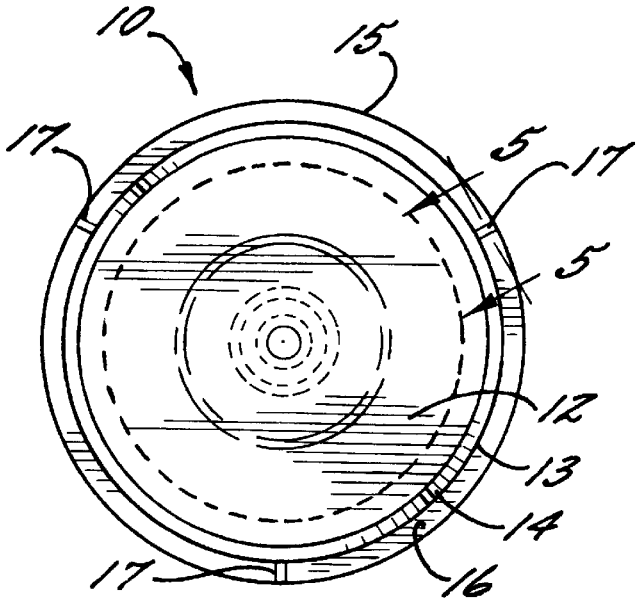
FIG. 4 is an elevational view of the inside face of the adapter constructed in accordance with this invention and taken generally along the line 4—4 of FIG. 3.

It is conventional in yarn winding operations of this type to place a yarn transfer tail T across the bottom of the carrier 20 (as shown in FIG. 3). This transfer tail T is constructed such that it can be pulled out of the wound package of yarn Y on the carrier 20 and utilized for connecting one wound package of yarn Y to another wound package of yarn Y in a subsequent textile operation. When a carrier 20 is placed on the yolk arm assembly A of the take-up winding assembly W it already has some wraps of yarn Y thereon and the transfer tail T in position across the bottom of the yarn carrier 20 as shown in FIG. 3. When the carrier 20 is placed on an adapter 10, breakage or cutting of the yarn tail T can occur if a pinching action results between the end of the carrier 20 and the face of the adapter 10 and this cutting or breaking can also be caused by relative rotation between the carrier 20 and the adapter 10 when the carrier 20 is being driven during the winding operation by the driven roll R.

To eliminate this problem of cutting or breaking of the yarn transfer tail T on the yarn carrier 20, an improved construction in accordance with this invention of a first embodiment of the adapter 10 is provided and is illustrated in FIGS. 2–7.

This improved construction of the first embodiment of adapter 10 includes a hub portion 12 for extending axially into the tubular end of the yarn carrier 20 to center the yarn carrier 20 on the adapter 10 when the yarn carrier 20 is being placed on the adapter 10. The hub portion includes an outside surface preferably having a first cylindrical surface area 13 with a cross-sectional diameter less than the diameter of an adjacent inside surface 21 of the carrier 20 and a frusto-conical surface area 14 extending axially from the cylindrical surface area 13. The cylindrical area 13 and the frusto-conical surface area 14 of the hub portion 12, since they are both of a cross-sectional diameter less than the diameter of the inside surface 21 of the yarn carrier 20, define a space S1 between the outside surface 13, 14 of the hub portion 12 and the inside surface 21 of the yarn carrier 20 to accommodate the placement of the yarn tail T (as may be seen in FIG. 2) without pinching thereof.

Figure 6:
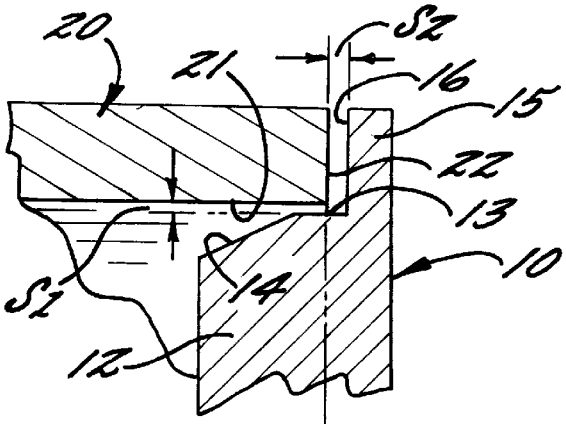
FIG. 6 is an enlarged, partial, sectional view of generally the upper portion of an adapter and yarn carrier mounted thereon, as shown in FIG. 2, with the yarn tail removed therefrom but specifically illustrating the space formed between these members to accommodate the yarn tail.
Figure 7:
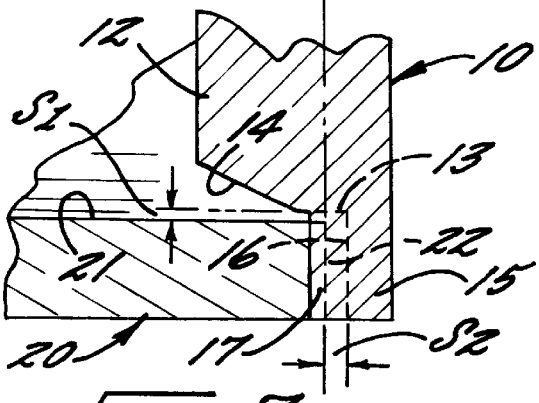
FIG. 7 is a view, like FIG. 6, of the lower portion of the adapter with a yarn carrier mounted thereon, as illustrated in FIG. 2, and specifically illustrating a spaced rib and the engagement thereof with the yarn carrier.

The adapter 10 further includes an annular flange portion 15 extending radially outwardly from the rear of the cylindrical surface area 13 of the hub portion 12 and having an inside surface area 16 for being positioned adjacent an end surface 22 of the yarn carrier 20. The annular flange portion 15 preferably has a radial length substantially equal to at least the radial length of the end surface of the yarn carrier (as shown in FIGS. 2, 6 and 7).

Figure 2:
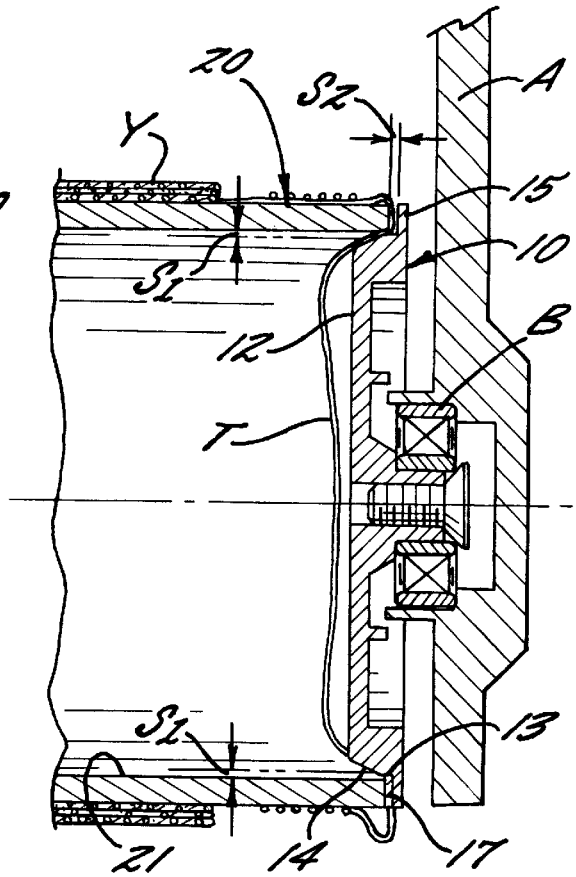
FIG. 2 is a partial, enlarged sectional view through the adapter and yarn carrier mounted thereon in the take-up winding assembly of FIG. 1 and taken generally along the line 2—2 of FIG. 1.
Figure 5:
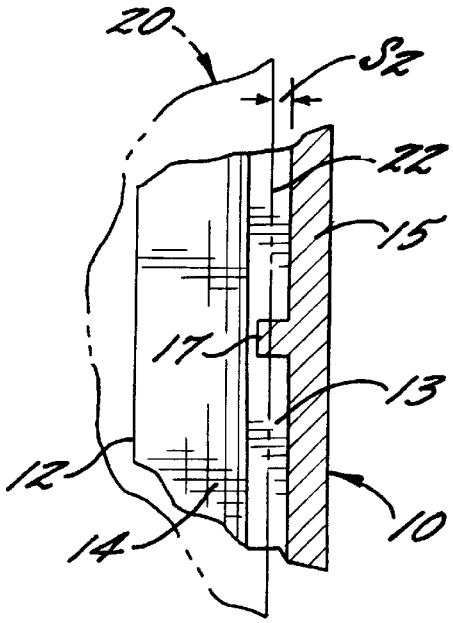
FIG. 5 is a sectional view through one of the spaced ribs on the annular flange portion of the adapter of FIG. 4 and showing a yarn carrier mounted on the adapter in phantom lines and taken generally along the line 5—5 of FIG. 4.

Means are formed on this annular flange portion 15 (1) for abutting the end surface 22 of the yarn carrier to define a space S2 between the end surface 22 of the yarn carrier 20 and the inside surface 16 of the annular flange 15 to accommodate the placement of the yarn tail T therein (as shown in FIG. 2) and (2) for engaging and preferably slightly penetrating the end surface 22 of the yarn carrier 20 to prevent relative rotation between the yarn carrier 20 and the adapter 10 during a winding operation. This means is preferably in the form of three ribs 17 formed on and equally spaced around the flange portion 15 and extending axially from the inside surface 16 of the flange portion 15 and preferably radially along the entire radial length of the inside surface 16 of the annular flange portion 15 (1) for abutting the entire radial length of the end surface 22 of the yarn carrier 20 to define the space S2 and (2) for engaging, preferably in the case of a paper yarn carrier 20 slightly penetrating, the end surface 22 of the yarn carrier 20 (as indicated in the indentations in FIG. 3 and as indicated in FIGS. 2, 5 and 7) to prevent relative rotation between the yarn carrier 20 and adapter 10.

While the preferred form of means formed on the annular flange portion 15 of the adapter 10 has been described as being in the form of three equally spaced ribs 17, it may be that other numbers of ribs 17 or other types of spacing and engaging means may be utilized to accomplish the purposes of this invention and be within the scope of this invention. The adapter 10 may be formed of any suitable material, such as plastic, and may be injection molded from plastic.

Figure 8:
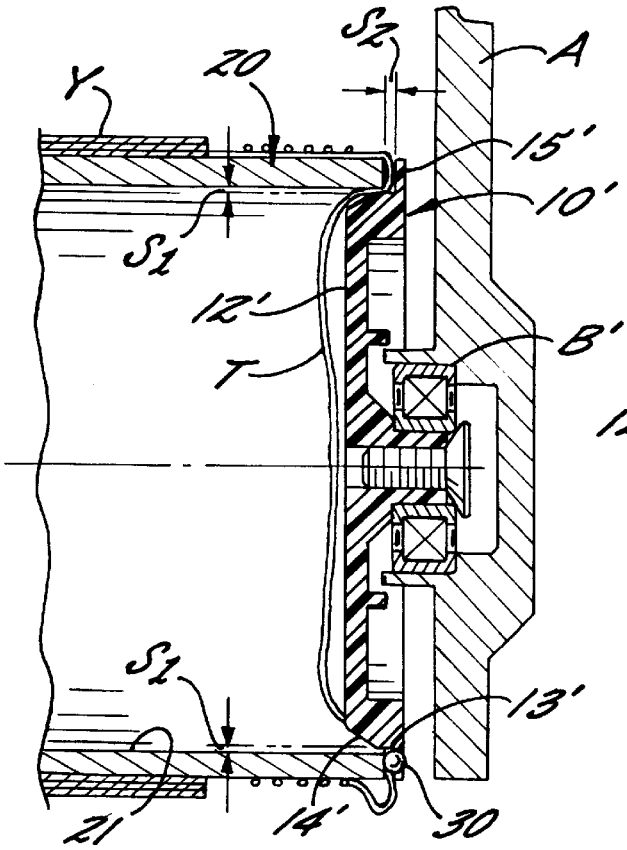
FIG. 8 is a partial, enlarged sectional view through the adapter and yarn carrier mounted thereon in a take-up winding assembly, like FIG. 2, but illustrating a second embodiment of adapter.
Figure 10:
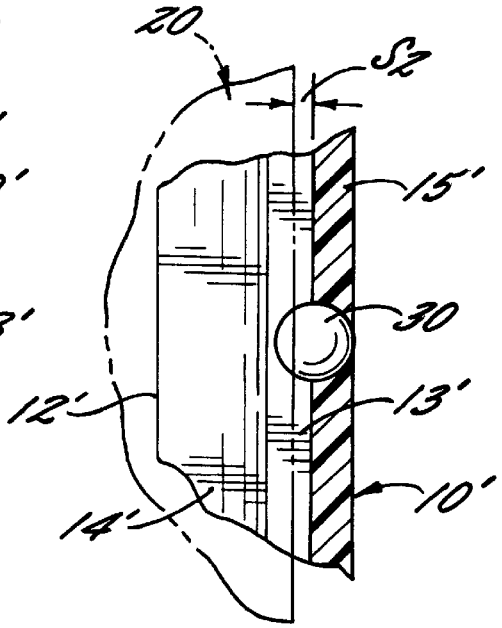
FIG. 10 is a partial sectional view taken generally along the line 10—10 of FIG. 9.
Figure 9:
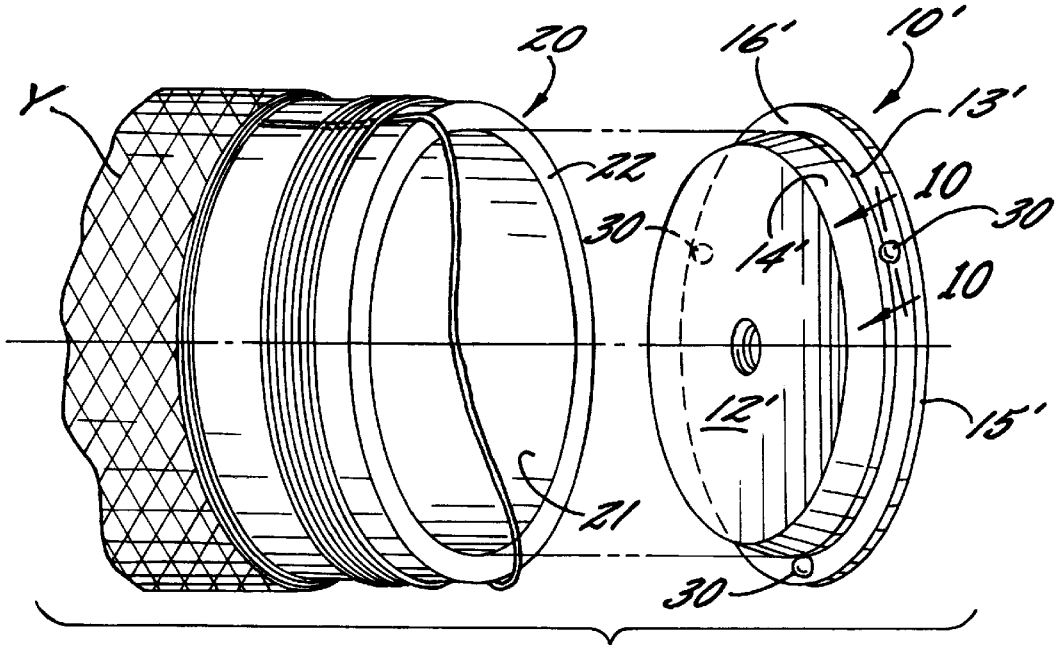
FIG. 9 is an exploded perspective view of the end of the yarn carrier and the second embodiment of the adapter of this invention.

To eliminate the above described problem of cutting or breaking of the yarn tail T on the yarn carrier 20, an improved construction in accordance with this invention of a second embodiment of adapter 10' is provided and is illustrated in FIGS. 8–10. The structural features of this second embodiment of adapter 10' which are the same as the first embodiment of the adapter 10 utilize the same reference numerals with a "'" notation.

This second embodiment of adapter 10' includes a hub portion 12' for extending axially into the tubular end of the yarn carrier 20 to center the yarn carrier on the adapter 10' when the yarn carrier 20 is being placed on the adapter 10'. The hub portion includes an outside surface preferably having a first cylindrical surface area 13' with a cross-sectional diameter less than the diameter of the adjacent inside surface 21 of the carrier 20 and a frusto-conical surface area 14' extending axially from the cylindrical surface area 13'. The cylindrical area 13' and the frusto-conical surface area 14' of the hub portion 12', since they are both of cross-sectional diameter less than the diameter of the inside surface 21 of the yarn carrier 20, define space S1 between the outside surface 13', 14' of the hub portion 12' and the inside surface 21 of the yarn carrier 20 to accommodate the placement of the yarn tail T (as may be seen in FIG. 8) without pinching thereof. The adapter 10' further includes an annular flange portion 15' extending radially-outwardly from the rear of the cylindrical surface 13' of the hub portion 12' and having an inside surface area 16' for being positioned adjacent the end 22 of the yarn carrier 20. The annular flange portion 15' preferably has a radial length substantially equal to at least the radial length of the end surface 22 of the yarn carrier 20 (as shown in FIG. 8).

Means are formed on the annular flange portion 15' (1) for abutting the end surface 22 of the yarn carrier to define space S2 between the end surface 22 of the yarn carrier 20 and the inside surface 16' of the annular flange 15' to accommodate the placement of the yarn tail T therein (as shown in FIG. 8) and (2) for engaging and preferably slightly penetrating the end surface 22 of the yarn carrier 20 to prevent relative rotation between the yarn carrier 20 and the adapter 10' during a winding operation.

This means in the second embodiment of this invention is preferably in the form of three spherical bodies 30 positioned in and equally spaced around the flange portion 15' for abutting the end surface 22 of the yarn carrier 20 to define the space S2 and for engaging and preferably in the case of a paper yarn carrier 20 slightly penetrating the end surface 22 of the yarn carrier 20 (as indicated in FIGS. 8 and 10) to prevent relative rotation between the yarn carrier 20 and the adapter 10'.

It has been found preferable in connection with this second embodiment of adapter 10' that the adapter be formed of plastic material constructed by injection molding and that the spherical bodies 30 be in the form of metal ball bearings or metal spherical members which may be easily placed in proper position in the injection molding apparatus so that the injection molded adapter 20 is formed with these spherical bodies 30 in proper position.

While the preferred form of means formed on the annular flange portion 15' of this second embodiment of adapter 10' has been described as being in the form of three equally spaced spherical members 30, it may be that any number of spherical members 30 or other types of spacing and engaging means may be utilized to accomplish the purposes of this invention and may be within the scope of this invention. Also, the adapter 10' may be formed of any suitable materials including the above described injection molded plastic material.

While the adapter 10 of the first embodiment of this invention described above functions satisfactorily for the purposes described therein, it has been found that the spaced ribs 17 which are normally formed out of the same material as the adapter 10, suffer from excessive wear as a result of supporting multiple yarn carriers during multiple winding operations. The second embodiment of this invention which utilizes metal or stainless steel spherical members or balls have overcome this problem by eliminating wear of these particular members 30.

As may be seen from the above detailed description of preferred embodiments of this invention, improved adapters 10 and 10' have been described for rotatably supporting a tubular end of a yarn carrier 20 in a take-up winding assembly W of a yarn processing machine P and which provide constructions to accommodate the placement of a yarn transfer tail T across the end surface 22 of the yarn carrier 20 and between the yarn carrier 20 and the adapter 10 or 10' without breaking or cutting of the yarn transfer tail T during winding of the yarn Y.

In the drawings and specification that have been set forth a preferred embodiment of the invention, and although specific terms are employed, they are used in a generic and descriptive sense only and not for purposes of limitation. It will be apparent that variations and modifications can be made within the spirit and scope of this invention, as described in the foregoing detailed specification and as defined in the following claims.

What is claimed is:

1. A yarn carrier having at least one tubular end including an inside surface of predetermined diameter and an end surface of predetermined thickness, and an adapter for rotatably supporting said end of said yarn carrier in a take-up winding assembly of a yarn processing machine, said carrier and said adapter being characterized by constructions which accommodate the placement of a yarn transfer tail across said end surface of said yarn carrier and between said yarn carrier and said adapter without breaking or cutting of the yarn transfer tail; said adapter comprising:

a hub portion having a forward end and a rear end and extending axially from said forward end into said tubular end of said yarn carrier to center said yarn carrier on said adapter and having an outside surface with a cross-sectional diameter less than the predetermined diameter of said inside surface of said yarn carrier for defining a first space therebetween to accommodate the placement of the yarn tail in said first space without breaking or cutting of the yarn tail;

an annular flange portion extending radially outwardly from said rear end of said hub portion and having an inside surface for being positioned adjacent said end surface of said yarn carrier; and spherical members positioned on said annular flange portion and extending axially from said inside surface of said annular flange portion (1) for abutting said end surface of said yarn carrier to define a second space between said end surface of said yarn carrier and said inside surface of said annular flange to accommodate the placement of the yarn tail in said second space without breaking or cutting of the yarn tail and (2) for engaging said end surface of said yarn carrier to retard relative rotation between said yarn carrier and said adapter.

2. A yarn carrier and adapter, as set forth in claim 1, in which said spaced spherical members comprise three members equally-spaced around said annular flange portion of said adapter.

3. A yarn carrier and adapter, as set forth in claim 1 or 2, in which said outside surface of said hub portion includes a cylindrical surface area extending axially from said annular flange portion and having a cross-sectional diameter less than said predetermined diameter of said inside surface of said yarn carrier, and a frusto-conical surface area extending forwardly and axially from said cylindrical surface area.

* * * * *